US009572425B2

(12) United States Patent
Schulman

(10) Patent No.: US 9,572,425 B2
(45) Date of Patent: Feb. 21, 2017

(54) TRAY TABLE APPARATUS

(71) Applicant: Carl H. Schulman, Porter Ranch, CA (US)

(72) Inventor: Carl H. Schulman, Porter Ranch, CA (US)

( * ) Notice: Subject to any disclaimer, the term of this patent is extended or adjusted under 35 U.S.C. 154(b) by 0 days.

(21) Appl. No.: 14/803,878

(22) Filed: Jul. 20, 2015

(65) Prior Publication Data

US 2016/0015170 A1 Jan. 21, 2016

Related U.S. Application Data

(60) Provisional application No. 62/026,062, filed on Jul. 18, 2014.

(51) Int. Cl.

| | |
|---|---|
| ***A47B 88/00*** | (2006.01) |
| ***A47B 23/02*** | (2006.01) |
| ***A47B 23/00*** | (2006.01) |
| ***A47B 83/04*** | (2006.01) |

(52) U.S. Cl.

CPC ..... *A47B 23/02* (2013.01); *A47B 23/001* (2013.01); *A47B 83/045* (2013.01)

(58) Field of Classification Search

CPC ..... A47B 3/08; A47B 83/045; A47B 23/02; A47B 23/001

USPC ..... 312/311; 108/39

See application file for complete search history.

(56) References Cited

U.S. PATENT DOCUMENTS 1,220,578 A 3/1917 Wise
1,532,312 A * 4/1925 Hurd ..... D06F 81/06 108/116
1,737,441 A * 11/1929 Ulmer, Jr. ..... A47B 23/02 312/309
1,928,327 A * 9/1933 Butler ..... A47B 23/02 108/33
2,525,975 A * 10/1950 Thomas ..... A47B 17/036 16/362
2,612,422 A 9/1952 Sarkus
2,819,141 A * 1/1958 Myer ..... A47J 47/005 126/333
3,054,122 A 9/1962 Sarkus
(Continued)

FOREIGN PATENT DOCUMENTS

| | | |
|---|---|---|
| AT | 102137 | 12/1925 |
| CN | 2669696 | 1/2005 |

(Continued)

*Primary Examiner* — Hanh V Tran

(74) *Attorney, Agent, or Firm* — The Belles Group, P.C.

(57) ABSTRACT

A tray table apparatus including a tray table and a tray table support assembly coupled to the tray table. The tray table and the tray table support assembly are configured to transition between a stowed position and a deployed position. The tray table support assembly includes: a support shelf; a support arm having a first end pivotably coupled to the support shelf so as to be pivotable about a first pivot axis and a second end, the tray table pivotably coupled to the second end of the support arm so as to be pivotable about a tray table pivot axis; and an adjustable pivot stop positioned to limit pivot movement of the support arm about the first pivot axis in the deployed position, such that a selected adjustment position of the adjustable pivot stop determines an angle of inclination formed between the support arm and the support shelf.

20 Claims, 13 Drawing Sheets

(56) References Cited

U.S. PATENT DOCUMENTS

| | | | | |
|---|---|---|---|---|
| 3,805,711 | A * | 4/1974 | Lakso | A47C 4/10 108/133 |
| 5,606,918 | A * | 3/1997 | Cauffiel | A47B 23/02 108/42 |
| 6,253,688 | B1 * | 7/2001 | Lor | A47B 23/001 108/129 |
| 6,412,423 | B1 * | 7/2002 | Elizondo, Jr. | A47B 83/045 108/35 |
| 6,722,681 | B1 * | 4/2004 | Large | A61G 5/10 280/304.1 |
| 7,398,737 | B1 * | 7/2008 | Martellaro | B60N 3/001 108/143 |
| 7,585,033 | B2 * | 9/2009 | Holt | A47B 37/00 108/138 |
| 7,849,789 | B1 * | 12/2010 | Whelan | A22C 17/0013 108/116 |
| 9,010,885 | B2 * | 4/2015 | Kahle | A47B 83/045 108/40 |
| 2001/0052309 | A1 * | 12/2001 | Allen | A47B 77/10 108/33 |
| 2003/0000429 | A1 * | 1/2003 | Ryburg | A45C 7/00 108/42 |
| 2003/0076014 | A1 * | 4/2003 | Kelley | A47B 21/00 312/194 |
| 2007/0034767 | A1 * | 2/2007 | Mastropaolo | A47B 23/02 248/447.2 |
| 2009/0200437 | A1 * | 8/2009 | Smed | A47B 9/16 248/121 |
| 2012/0326472 | A1 * | 12/2012 | Wu | A47C 7/70 297/135 |

FOREIGN PATENT DOCUMENTS

| | | | |
|---|---|---|---|
| CN | 202932323 | U | 5/2013 |
| CN | 203506037 | U | 4/2014 |
| CN | 203986898 | U | 12/2014 |
| DE | 218058 | | 1/1910 |
| DE | 591011 | | 1/1934 |
| EP | 1658784 | B1 | 4/2008 |
| FR | 1164493 | | 10/1958 |

* cited by examiner

TRAY TABLE APPARATUS

CROSS REFERENCE TO RELATED APPLICATIONS

The present application claims the benefit of U.S. Provisional Patent Application Ser. No. 62/026,062, filed Jul. 18, 2014, the disclosure of which is incorporated herein by reference in its entirety.

FIELD OF THE INVENTION

The field of the present invention relates to tray tables, such as tray tables which may extend out over a bed for use as an in-bed table and may retract when not being used.

BACKGROUND OF THE INVENTION

Tray tables for use in the bed are common, and for people who choose or need to eat, read, or work in bed, having a bedside tray table that extends out over the bed when needed and stows out of the way is an indispensable convenience. Such stowable tray tables are known in the art, however they often are attached to limitations that turn their use into a frustrating convenience. For example, some stowable tray tables have too many degrees of freedom, such as is seen in the tray table disclosed in U.S. Pat. No. 1,220,578, as all the degrees of freedom make the tray table too easily bumped out of the position in which it is set. Others have more limited degrees of freedom, but some of those degrees of freedom are not easy to use for a person who is lying in the bed and needs to adjust the position of the bed tray, such as the tray table disclosed in U.S. Pat. No. 3,054,122.

For a person who is lying in bed, having a tray table with limited degrees of freedom is acceptable when the degrees of freedom provided make the tray table easy to use for a person lying in the bed and at the same time provide a sufficiently stable platform which may be used and not too easily bumped out of position. It is therefore desirable that a stowable tray table for use in the bed meet a balance between usability and stability. At the same time, another desirable feature for some stowable tray tables is that they can be stowed entirely out of sight when not in use.

SUMMARY OF THE INVENTION

The present invention is directed toward a tray table apparatus which includes a tray table which is movable between a stowed position to a deployed position. When not in use, the tray table may be stowed out of the way in the stowed position. The stowable tray table is made to be particularly easy to use by a person lying in a bed. When in use, the tray table provides adjustment mechanisms by which a person may easily adjust at least two degrees of freedom: the height of the tray table above another surface, such as a bed, and the lateral position of the tray table between, such as between the head and foot of a bed.

In a first separate aspect of the present invention, a tray table apparatus includes: a tray table; and a tray table support assembly coupled to the tray table, the tray table and the tray table support assembly configured to transition between a stowed position and a deployed position. The tray table support assembly includes: a support shelf; a support arm having a first end pivotably coupled to the support shelf so as to be pivotable about a first pivot axis and a second end, the tray table pivotably coupled to the second end of the support arm so as to be pivotable about a tray table pivot axis; and an adjustable pivot stop positioned to limit pivot movement of the support arm about the first pivot axis in the deployed position, such that a selected adjustment position of the adjustable pivot stop determines an angle of inclination formed between the support arm and the support shelf.

In a second separate aspect of the present invention, a tray table apparatus includes: a tray table; and a tray table support assembly coupled to the tray table, the tray table and the tray table support assembly configured to transition between a stowed position and a deployed position. The tray table support assembly includes: a support shelf; and a support arm, the support arm having a first end pivotably coupled to the support shelf so as to be pivotable about a first pivot axis and a second end, the tray table pivotably coupled to the second end of the support arm so as to be pivotable about a tray table pivot axis and translatable, relative to the support arm, in a direction parallel to the tray table pivot axis.

In a third separate aspect of the present invention, a tray table apparatus includes: a tray table having a first end and a second end; and a tray table support assembly coupled to the tray table, the tray table and the tray table support assembly being configured to transition between a stowed position and a deployed position. The tray table support assembly includes: a support shelf; a support arm having a first end pivotably coupled to the support shelf so as to be pivotable about a first pivot axis and a second end, the first end of the tray table pivotably coupled to the second end of the support arm so as to be pivotable about a tray table pivot axis; and a support leg pivotably coupled to the tray table adjacent the second end of the tray table, the support leg configured to be adjustable in length.

In a fourth separate aspect of the present invention, a tray table apparatus includes: a support structure; a tray table; and a tray table support assembly coupled to the tray table and mounted to the support structure, the tray table and the tray table support assembly configured to transition between a stowed position and a deployed position. The tray table support assembly includes: a support shelf having a first end and a second end opposite the first end; and a support arm having a first end and a second end, the tray table pivotably coupled to the second end of the support arm so as to be pivotable about a tray table pivot axis. The support arm is alterable between: (1) a first state in which the first end of the support arm is pivotably coupled to the support shelf so as to be pivotable about a first pivot axis between a first folded position in which the support arm lies atop the support shelf and a first unfolded position in which the support arm extends in a first inclined orientation such that the second end of the support arm is located laterally beyond the first edge of the support shelf; and (2) a second state in which the first end of the support arm is pivotably coupled to the support shelf so as to be pivotable about a second pivot axis between a second folded position in which the support arm lies atop the support shelf and a second unfolded position in which the support arm extends in a second inclined orientation such that the second end of the support arm is located laterally beyond the second edge of the support shelf.

In a fifth separate embodiment of the present invention, a tray table apparatus includes: a tray table having a first end and a second end; a telescoping leg pivotably affixed adjacent the second end of the tray table; a handle affixed to the second end of the tray table; and a tray table support assembly coupled to the tray table, the tray table and the tray table support assembly configured to transition between a stowed position and a deployed position. The tray table support assembly includes: a support shelf having a lateral centerline, a first pivot axis, and a second pivot axis, with the first pivot axis and the second pivot axis being symmetrical to each other with respect to the lateral centerline; a support arm including at least one first pivot member pivotably coupled to the support shelf along one of the first pivot axis and the second pivot axis, and a second pivot member pivotably coupled adjacent to the first end of the tray table; an adjustable pivot stop positioned to limit pivot movement of the support arm with respect to the support shelf in the deployed position, such that an adjustment position of the adjustable pivot stop determines a height of the tray table in the deployed position; a pivot block pivotably coupling the second pivot member of the support arm to the tray table, wherein the pivot block is configured to be slidable along a longitudinal axis of the second pivot member; and a support leg pivotably coupled to the tray table adjacent the second end, the support leg being configured to be adjustable in length.

Accordingly, an improved tray table apparatus having a stowable tray table is disclosed. Advantages of the improvements will be apparent from the drawings and the description of the preferred embodiment.

BRIEF DESCRIPTION OF THE DRAWINGS

The foregoing summary, as well as the following detailed description of the exemplary embodiments, will be better understood when read in conjunction with the appended drawings. It should be understood, however, that the invention is not limited to the precise arrangements and instrumentalities shown in the following figures.

DETAILED DESCRIPTION OF THE INVENTION

Figure 1:
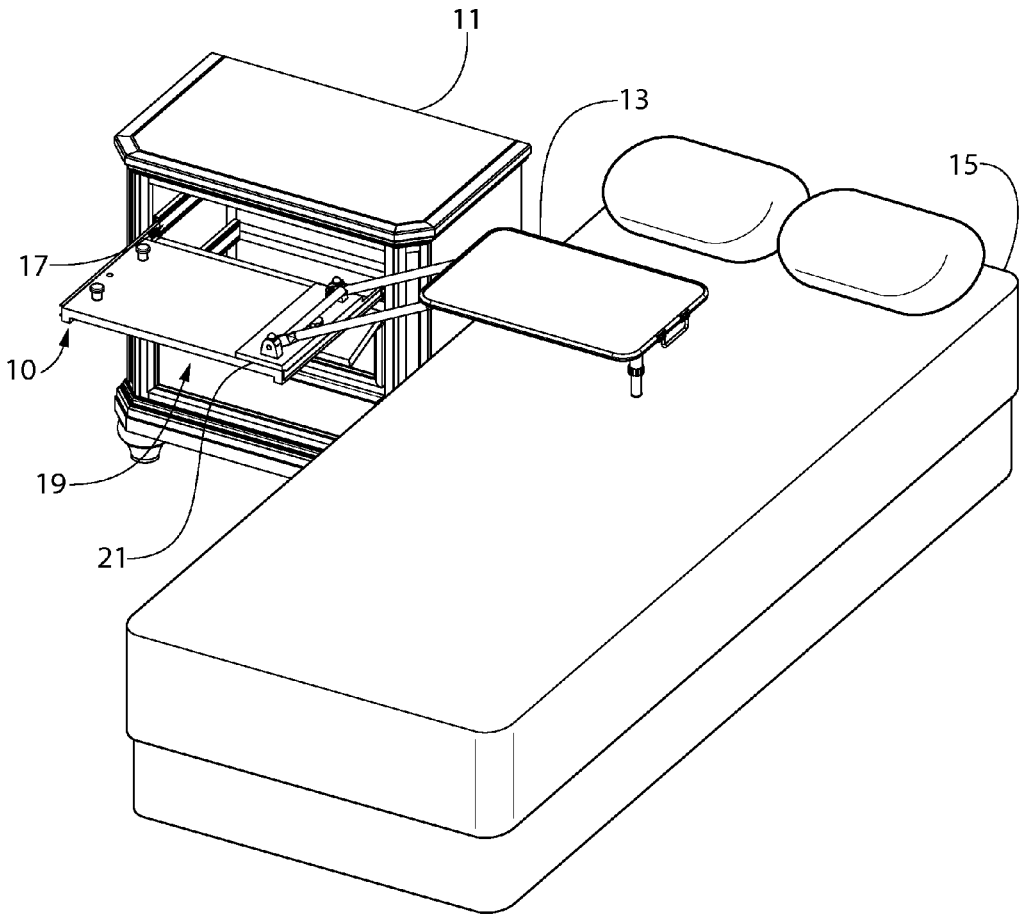
FIG. 1 is a perspective view of a first embodiment of a tray table apparatus, coupled to a night table, having a stowable tray table shown in the deployed position over a bed.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combinations of features that may exist alone or in other combinations of features; the scope of the invention being defined by the claims appended hereto.

As used herein, the term "night table" refers to any furniture that may be placed and/or used next to a bed. By way of example, a night table may be a free-standing piece of furniture having one or more storage compartments, such as a chest of drawers, or it may be a piece of furniture that is built-in to a wall or another piece of furniture, such as a bed or headboard. In addition, Those of skill in the art will recognize that the terms "night table," "nightstand," and "bedside table" are all used within the industry as standard descriptive names for the same type of furniture.

Turning in detail to the drawings, FIG. 1 shows an embodiment of a tray table apparatus 10 coupled to a night table 11. The tray table apparatus 10 includes a stowable tray table 13 shown in the deployed position over a bed 15. In the embodiment shown, the night table 11 includes an upper storage compartment 17 and a lower storage compartment 19, with the tray table apparatus 10 being stowed in the upper storage compartment 17. The night stand 11 and the upper and lower storage compartments 17 are intended to be non-limiting features of the invention, unless otherwise recited in the claims. As such, the night stand 11, along with its upper and lower storage compartments 17, 19, and the bed 15 are shown and described herein to illustrate one context, amongst the many possible, in which the tray table apparatus 10 may be used.

The tray table apparatus 10 includes a tray table support assembly 21 which is coupled to and provides support for the tray table 13. The tray table apparatus 10 transitions between the deployed position and a stowed position as illustrated in FIGS. 1-5. When the tray table support assembly 21 is in the stowed position, both the tray table 13 and the tray table support assembly 21 are stowed within the upper storage compartment 17.

Figure 2:
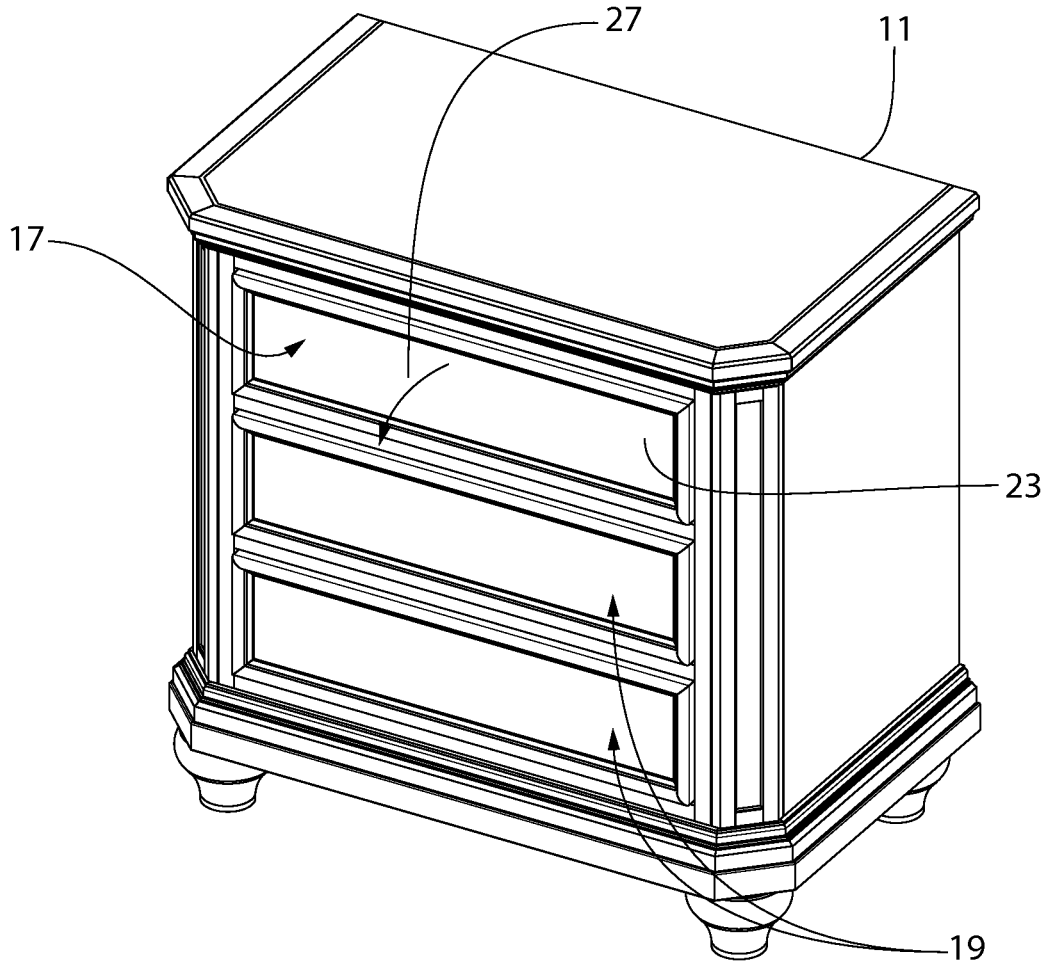
FIG. 2 is a perspective view of the tray table apparatus of FIG. 1 with the tray table in the stowed position.

The lower storage compartment 19 of the night stand 11 is shown as two drawers in FIG. 2. In certain embodiments, the lower storage compartment 19 may be one or more open shelves, one or more drawers, one or more cabinets, or any combination thereof. In addition, the lower storage compartment 19 may be sub-divided into two or more separate storage compartments. The lower storage compartment 19 may take any form desired for a particular implementation. In certain other embodiments, the lower storage compartment may be omitted entirely, such as in an implementation of a night table which is built-in to supported by a wall or other piece of furniture. In certain embodiments, the tray table apparatus 10 may be coupled to other types of furniture or support structures, some of which may not include any separate or distinct storage compartments.

Figure 3:
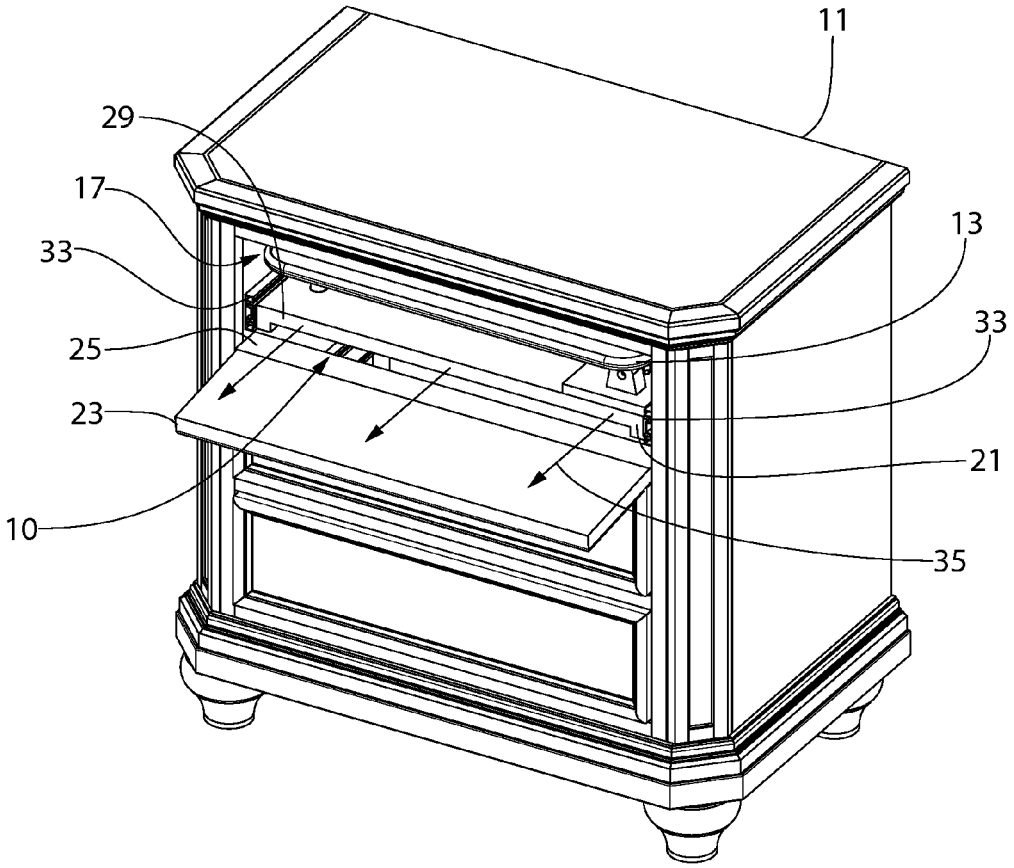
FIG. 3 is a perspective view of the tray table apparatus of FIG. 1 with the upper storage compartment of the night stand open so that the tray table may be transitioned from the stowed position to the deployed position.

As shown in FIG. 2, the upper storage compartment 17 of the night stand 11 includes a decorative facing 23 which serves to hide the tray table apparatus 10 stowed within the upper storage compartment 17 in the stowed position. In certain embodiments, the decorative facing 23 may be omitted. As shown in FIGS. 2 and 3, the decorative facing 23 is pivotably affixed to a cross member 25 within the night table 11. The decorative facing 23 may be pivoted in the direction shown by the arrow 27 to open the upper storage compartment 17, thereby giving a user access to the tray table apparatus 10 stowed therein. In alternative embodiments, the decorative facing 23 may be directly affixed to the tray table support assembly 21, thereby eliminating the need to pivot the decorative facing 23 prior to moving the tray table apparatus 10 out of the upper storage compartment 17.

Figure 4:
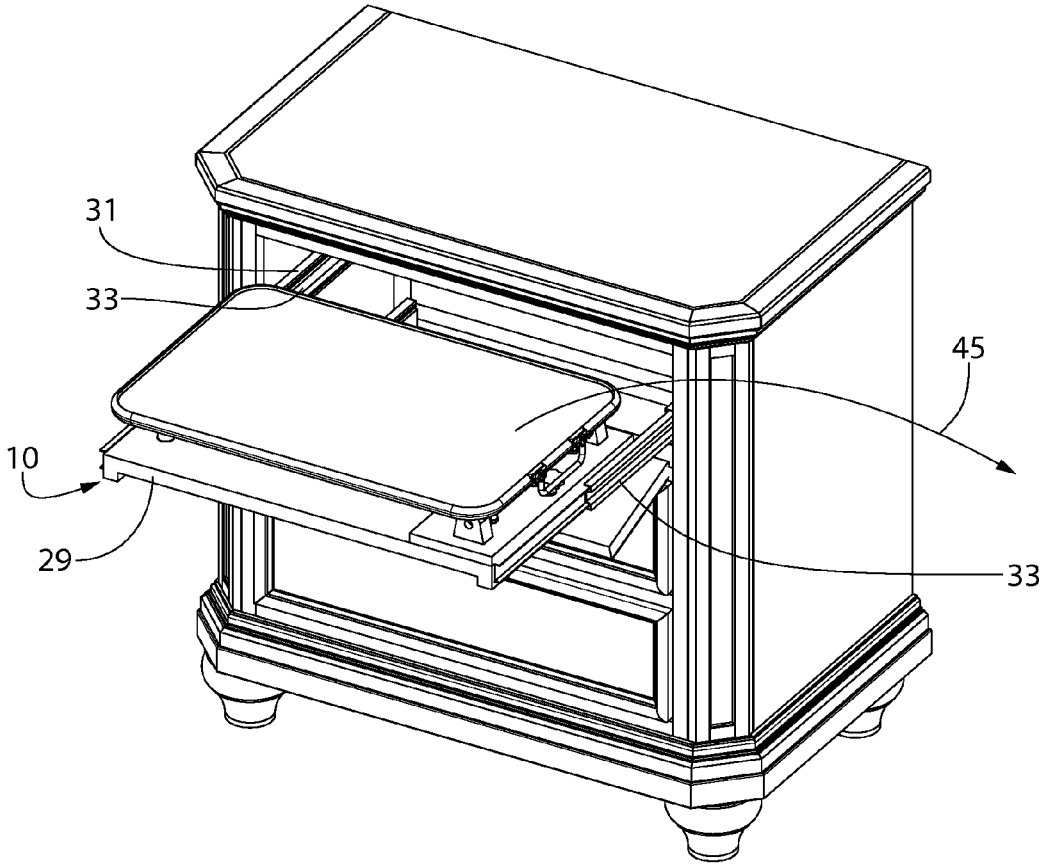
FIG. 4 is a perspective view of the tray table apparatus of FIG. 1 with the tray table in an intermediate position between the stowed position and the deployed position.

The tray table support assembly 21 includes a support shelf 29 which is coupled to the internal frame 31 of the night table 11 by drawer slides 33. The drawer slides 33 enable the stowed tray table apparatus 10 to slide out of the upper storage compartment 17 in the direction shown by arrows 35. In certain embodiments, the drawer slides 33 may be any appropriate type of mechanism which enables the tray table apparatus 10 to slide out from the upper storage compartment 17. The tray table apparatus 10 is shown in FIG. 4 in an intermediate position, outside of the upper storage compartment 17, during the transition between the stowed position and the deployed position. In this intermediate position, and also in the stowed position, the tray table support assembly 21 is in a folded position.

More particularly, on the drawer slides 33, the support shelf 29 translates, relative to the night stand 11, between a refracted position, in which the tray table support assembly 21 is in the stowed position within the upper storage compartment 17, and an extended position, in which the tray table support assembly 21 is in an intermediate position, before transitioning to the deployed position. During translation of the support shelf 29 from the extended position to the retracted position, and vice versa, the support shelf 29 travels in a plane of motion which is parallel to the pivot axes PA1, PA2, shown in FIG. 5.

Figure 5:
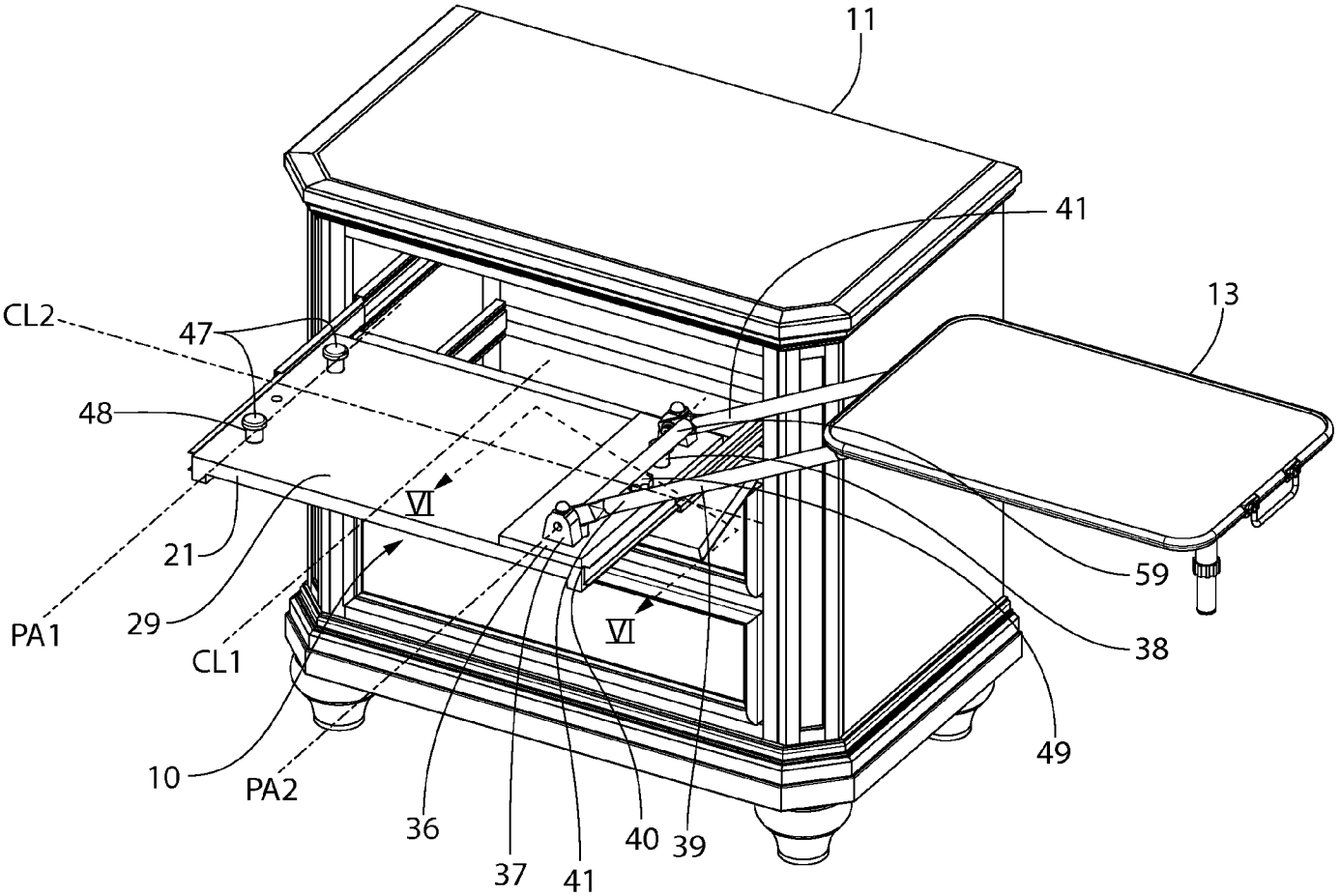
FIG. 5 is a perspective view of the tray table apparatus of FIG. 1 with the tray table in the deployed position.

The tray table apparatus 10 is shown in the deployed position in FIG. 5. The tray table support assembly 21 includes a base plate 36 affixed to the support shelf 29 and pivot blocks 37 mounted to the base plate 36. The base plate 36 is removably affixed to the support shelf 29 by threaded knobs 38 extending through the base plate 36 and into threaded receptacles (shown as threaded receptacles 42 in FIG. 11B) within the support shelf. A support arm 39 has a first end 40 with pivot members 41 pivotably coupled to the pivot blocks 37. As described in greater detail below, the base plate 36 may be coupled to the support shelf 29 to create one of two possible states for the tray table apparatus 21. In the first state of the tray table apparatus 21, the base plate 36 is coupled to the support shelf 29 in a first position so that the pivot blocks 37 form a first pivot axis PA1, and in the second state of the tray table apparatus 21, the base plate 36 is coupled to the support shelf 29 in a second position so that the pivot blocks 37 form a second pivot axis PA2. As shown in FIG. 5, the base plate 36 is coupled to the support shelf 29 in the second position.

In the embodiment shown, the pivot members 41 form sides of the support arm 39, and each pivot member 41 is positioned orthogonal to the pivot axis PA2. In certain embodiments, the support arm 39 may include at least one pivot member, and the at least one pivot member may be positioned at any angle to the pivot axis PA so as to allow the pivot motion when the tray table apparatus 10 transitions from the stowed position to the deployed position and vice versa.

With the pivot members 41 pivotably affixed to the pivot blocks 37, the support arm 39 is able to pivot with respect to the support shelf 29 for transitioning the tray table apparatus 10 between the intermediate position and the deployed position. As is discussed in greater detail below, the support arm 39 is also pivotably coupled to the tray table 13, so that when the support arm 39 moves during the transition between the intermediate position and the deployed position (as shown by arrow 45), the tray table 13 simultaneously can be pivoted with respect to the support arm 39. The tray table support assembly 21 also includes support blocks 47 secured into threaded receptacles (shown as threaded receptacles 44 in FIG. 11B), and the support blocks 47 serve to support the tray table 13 when the tray table apparatus 10 is in the stowed position or in the intermediate position.

Figure 11A:
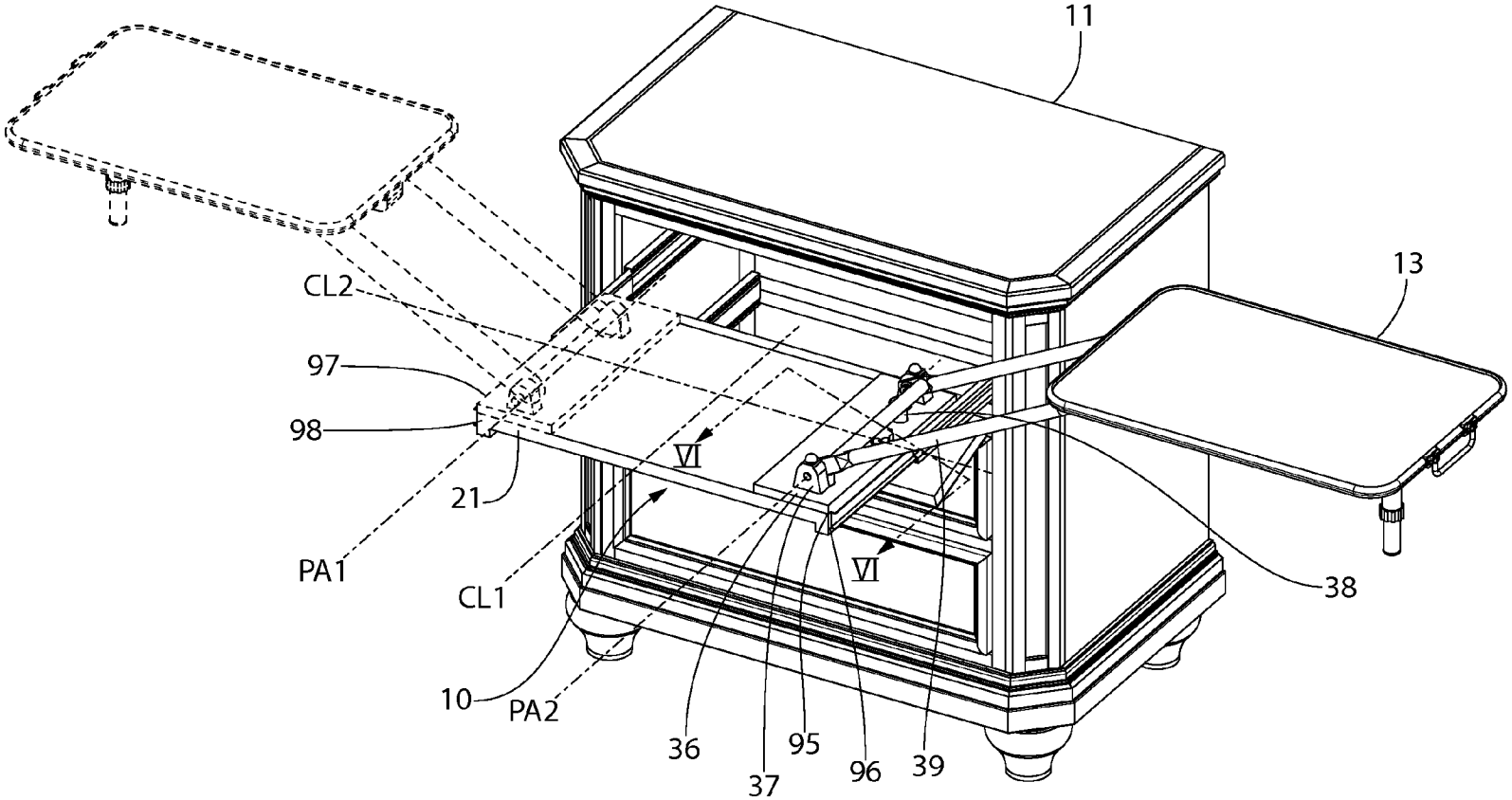
FIG. 11A is a perspective view of the tray table apparatus of FIG. 1 showing the reconfigurability of the tray table apparatus.
Figure 11B:
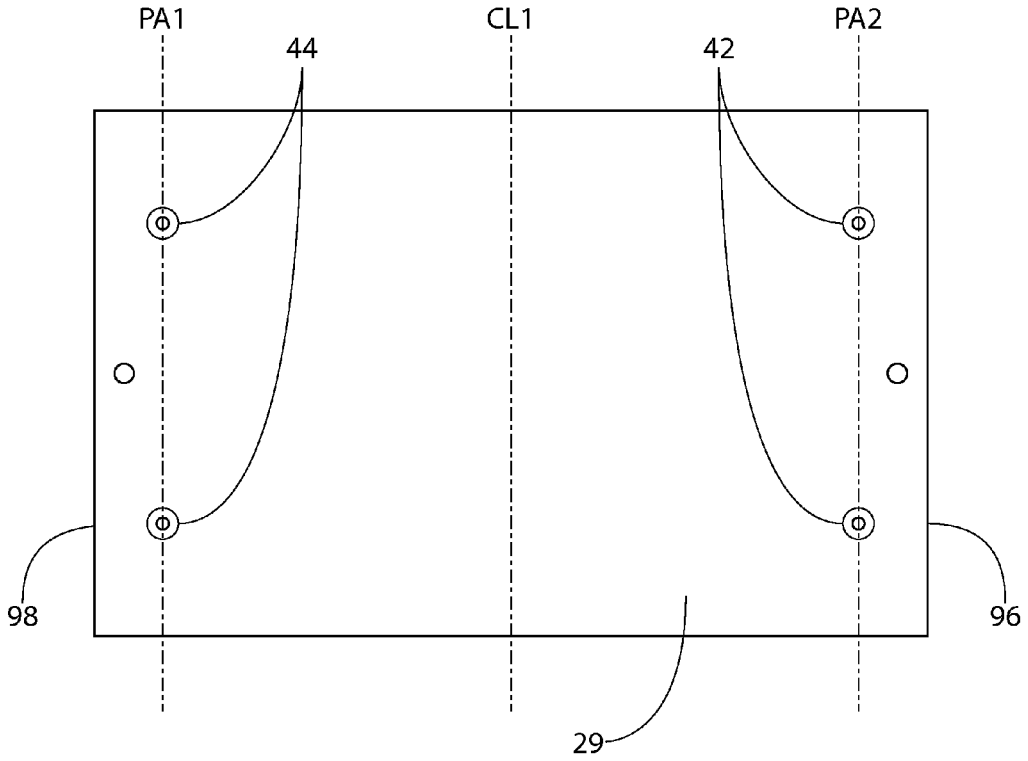
FIG. 11B is a top elevation view of the support shelf for the tray table apparatus of FIG. 1.

The threaded receptacles used to secure the base plate 36 to the support shelf 29 and the threaded receptacles used to secure the support blocks 47 to the support shelf 29 are symmetrically located about a lateral centerline CL1 and a longitudinal centerline CL2 of the support shelf 29. Symmetric placement of the respective threaded receptacles, along with the threaded knobs 38 used to secure the base plate 36 to the support shelf 29 allows the base plate 36 to be secured to either side of the support shelf 29. This configuration also permits the user to easily and quickly reconfigure the tray table apparatus 10 to be used in a deployed position with the tray table 13 extended out on either side of the tray table support assembly 21 (as is shown in FIG. 11A). This provides the tray table apparatus 10 with easy symmetrical reconfigurability, such that the two optional deployed positions for the tray table apparatus 10 are symmetrical about the lateral centerline CL1 of the support shelf 29.

With the support blocks 47 in place, when the tray table apparatus 10 is in the stowed position or in the intermediate position, the tray table 13 and the support shelf 29, and the support arm 39 are positioned in a plurality of parallel planes, with a first plane defined by the tray table 13, a second plane defined by the support shelf 29, and a third plane defined by the support arm 39. In certain embodiments, the support blocks 47 may include resilient caps 48 to aid in reducing wear and tear on the underside of the tray table 13 when the tray table apparatus 10 is in the stowed position or in the intermediate position.

Figure 6:
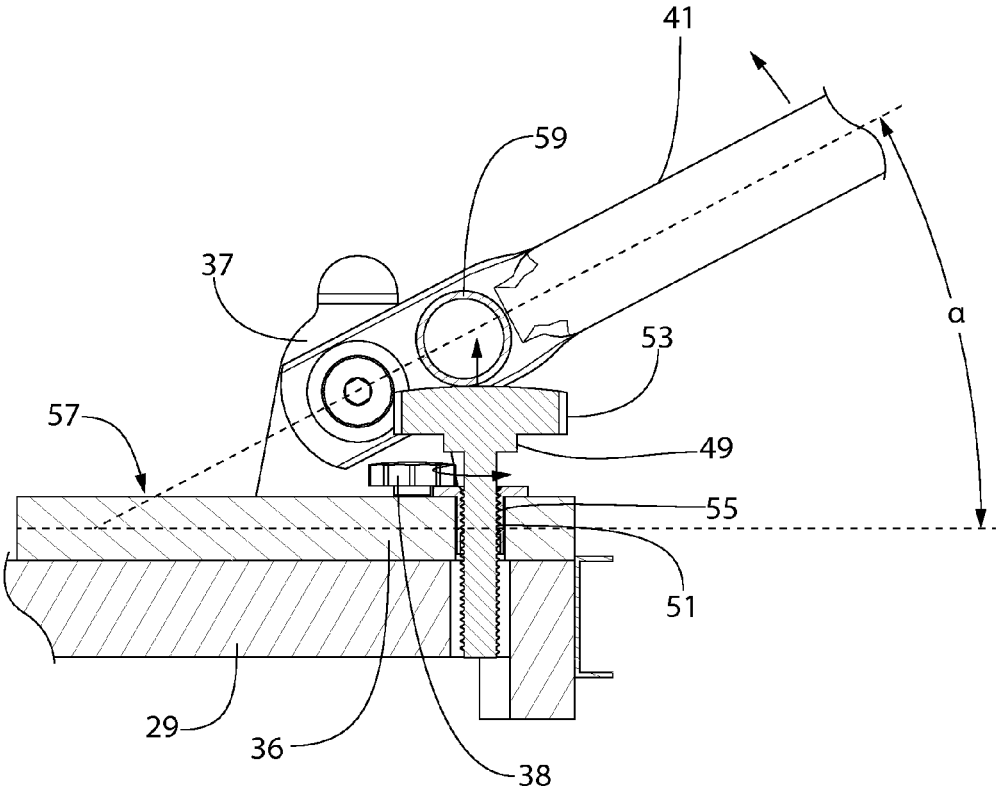
FIG. 6 is a sectional view of a portion of the tray table support assembly of the tray table apparatus of FIG. 1, showing the adjustable pivot stop.

The tray table support assembly 21 also includes a pivot stop 49, as is shown in FIGS. 5 and 6. In the embodiment shown, the pivot stop 49 is a screw element 51 coupled to a knob 53. The screw element 51 is secured into a threaded receptacle 55 included as part of the base plate 36, with the handle extending above the top surface 57 of the base plate 36. The support arm 39 includes a cross member 59 extending between the two pivot members 41, and the cross member 59 is positioned such that when the tray table support assembly 21 is in the deployed position, the cross member 59 comes into contact with the knob 53. Rotation of the screw element 51 adjusts the height of the knob 53 above the top surface 57 of the base plate 36. With this configuration, the knob 53 may have a selected adjustment position which serves to limit the pivot motion of the support arm 39. The pivot motion of the support arm 39 is limited to a pivot angle $\alpha$ with respect to the plane of the base plate 36. In the deployed position, the pivot angle $\alpha$ determines an angle of inclination formed between the support arm 39 and the support shelf 29. Thus, the height of the knob 53 above the top surface 57 of the base plate 36 therefore serves to determine the height of one side of the tray table 13, e.g., the height of the one side of the tray table 13 above the bed, when the tray table support assembly 21 is in the deployed position. As described below, the height of other side of the tray table 13 is determined by a telescoping leg.

Figure 7:
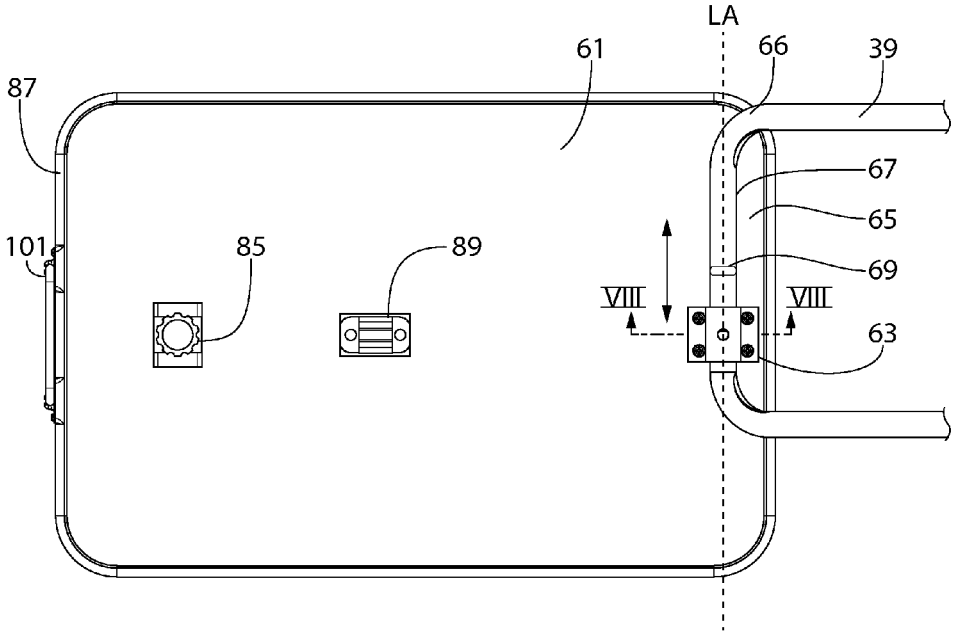
FIG. 7 is an elevation view of the bottom of the tray table of the tray table apparatus of FIG. 1.
Figure 8:
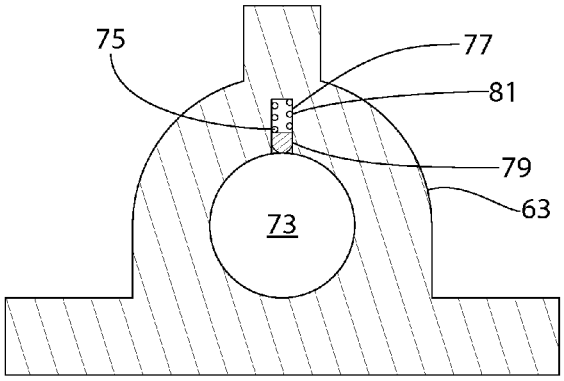
FIG. 8 is a sectional view of the pivot block along the line VIII-VIII of FIG. 7.

The bottom surface 61 of the tray table 13 is shown in FIG. 7. A tray pivot block 63 is mounted to the bottom surface 61 adjacent a first end 65 of the tray table 13. The tray pivot block 63 couples with a pivot member 67 of the support arm 39 to pivotably couple the support arm 39 to the tray table 13. The pivot member 67 extends along a longitudinal axis LA, and the tray pivot block 63 is movable by sliding along the longitudinal axis LA. In terms of the tray table 13 being placed over a bed, the sliding of the tray table 13, with respect to the support arm 39, means that the tray table may be moved toward and away from the foot/head of the bed. The support arm 39 includes an indent 69 at roughly a middle portion thereof to mark a centered position for the tray table 13. As is shown in FIG. 8, the tray pivot block 63 includes a through hole 73 for receiving the pivot member 67 of the support arm 39. Within the through hole 73, the tray pivot block 63 houses a biased ball assembly 75 within a recess 77. The biased ball assembly 75 includes a ball 79 biased by a spring 81 toward the center of the through hole 73, so that when the tray table 13 slides along the longitudinal axis LA, the biased ball 77 slightly catches within the indent 69 to alert the user that the tray table 13 is at the centered position. By enabling the user to more easily identify the centered position of the tray table 13, it is easier for the user to transition the tray table apparatus 10 from the deployed position to the stowed position and vice versa.

A support leg 85 is mounted adjacent and pivotably coupled to the bottom surface 61 adjacent the second end 87 of the tray table 13. A leg clip 89 is also mounted to the bottom surface 61 of the tray table 13. The support leg 85 is pivotable from a position parallel with the bottom surface 61 of the tray table 13 to a position that is orthogonal to the bottom surface 61. In the parallel position, the leg clip 89 engages the support leg 85 and secures support leg 85 to the bottom surface 61 of the tray table 13. In order to transition the tray table apparatus 10 into the stowed position from the deployed position, the support leg 85 is engaged with the leg clip 89 in the parallel position. When the tray table apparatus 10 is in the deployed position, the support leg 85 may be pivoted to the orthogonal position so that the support leg 85 can rest on the bed to provide additional stability and support to the tray table 13.

Figure 9:
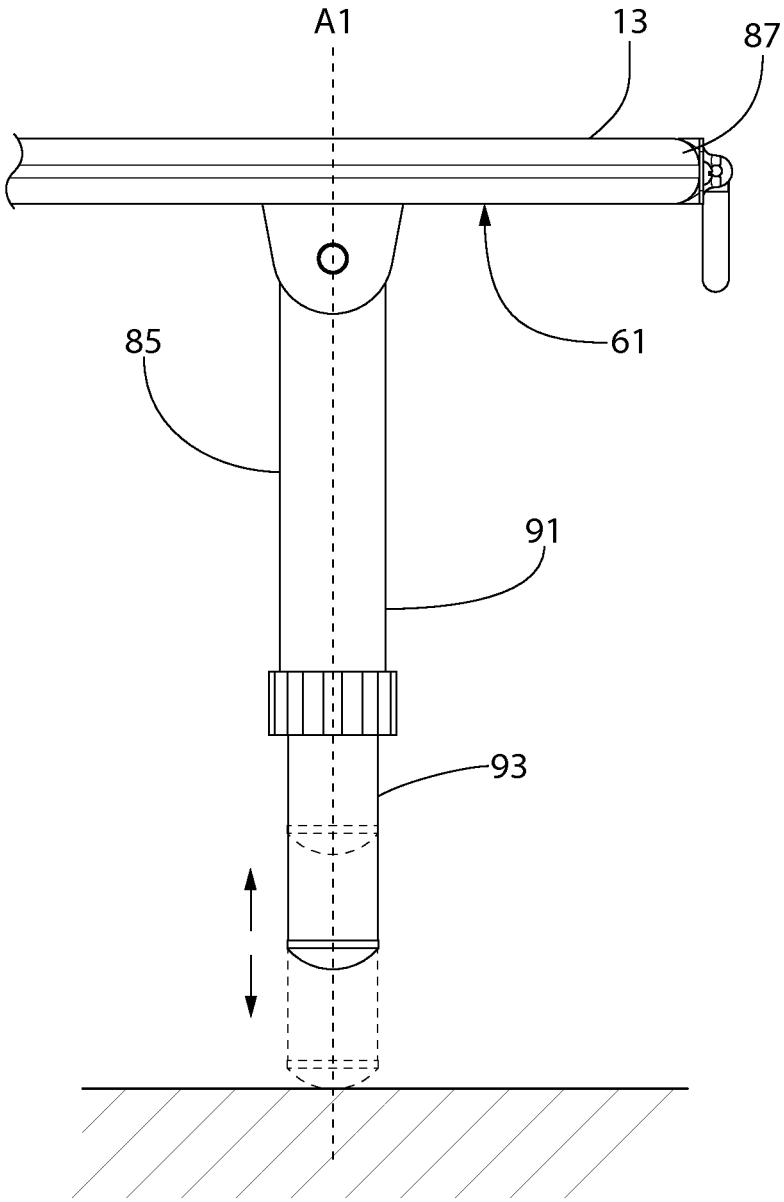
FIG. 9 is an elevation view of the support leg for the tray table of the tray table apparatus of FIG. 1.

As shown in FIG. 9, the support leg 85 is telescoping and includes a first leg segment 91 and a second leg segment 93, with the second leg segment 93 being movable along the leg axis A1 relative to the first leg segment 91. The support leg 85 may also include an appropriate locking mechanism, such as a clamp, a thumb screw, or the like, to secure the relative positions of the first and second leg segments 91, 93. By moving the second leg segment 93 along the leg axis A1, the support leg 85 is adjustable in length so that the second end 87 of the tray table 13 may be set at a desired height by a user.

Figure 10:
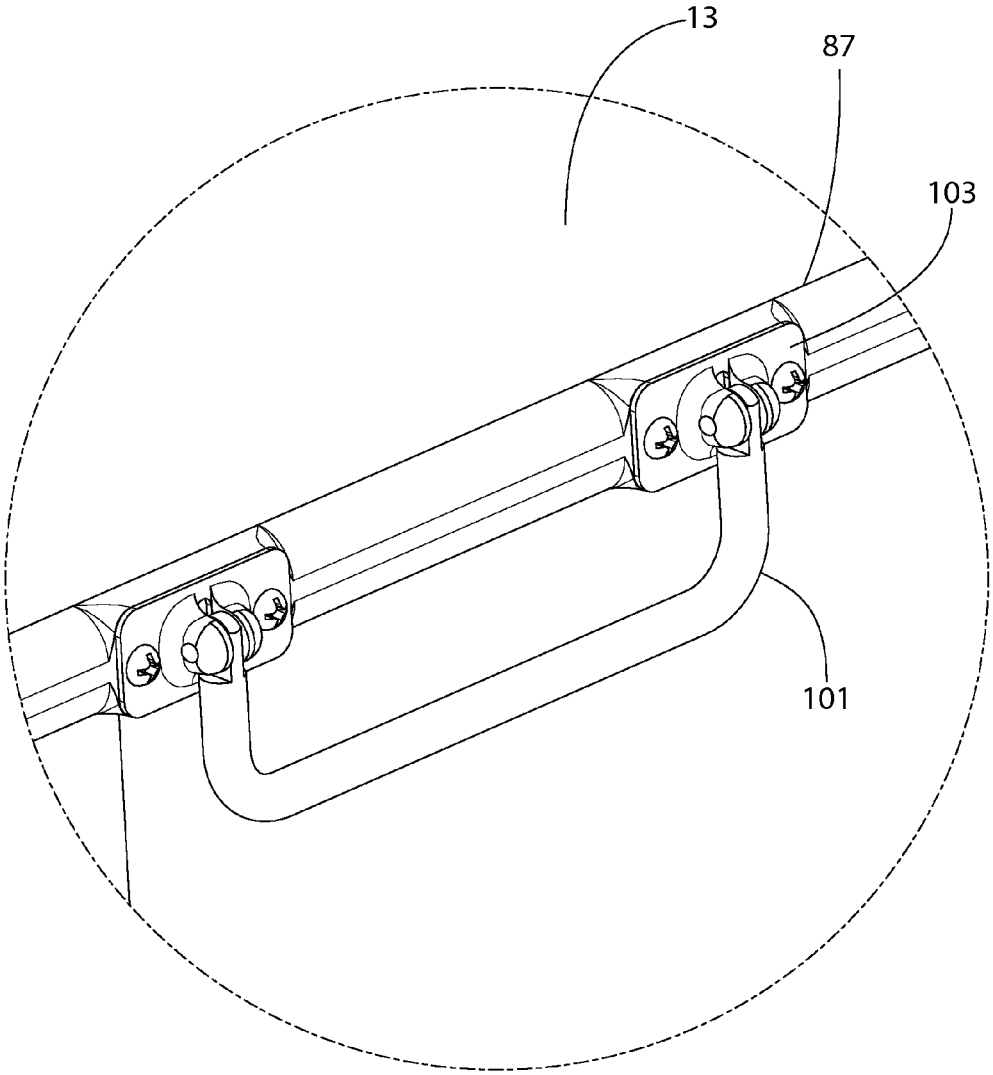
FIG. 10 is a perspective view of the handle for the tray table of the tray table apparatus of FIG. 1.

A handle 101 is affixed to the second end 87 of the tray table 13, as is shown in FIGS. 7 and 10. The handle 101 is mounted to the second end 87 of the tray table 13 with pivot brackets 103 which permit the handle 101 to pivot with respect to the tray table 13 and allow gravity to provide a downward bias to the pivot position of the handle 101. With the handle 101 configured in this manner, it facilitates transitioning the tray table apparatus 10 from the intermediate position to the deployed position, and at the same time, the handle 101 automatically hangs out of the way for placing the tray table apparatus 10 in the stowed position. Having the handle 101 positioned on the side of the tray table 13 makes it particularly easier for a user lying in a bed to transition the tray table apparatus 10 from the intermediate position to the deployed position.

It will be appreciated that the tray table apparatus 10 may be coupled to any support structure other than a night stand or furniture. For example, in certain embodiments, the tray table apparatus 10 may be coupled to a cart with wheels to provide a deployable tray table that may be used in any convenient circumstances. It will also be appreciated that the tray table apparatus 10 may be used in other circumstances which are not adjacent a bed. In addition, in certain embodiments the tray table apparatus 10 may be coupled to a support structure which may or may not include a storage compartment for stowing the tray table apparatus 10. In such embodiments without a storage compartment, the stowed position and the intermediate position of the tray table apparatus 10 may be one and the same position. In certain embodiments, such as one in which a storage compartment which opens from above the tray table apparatus 10, instead of opening from on the side, is used for the stowing the tray table apparatus 10, the tray table apparatus 10 may have no intermediate position, instead transitioning directly from the stowed position to the deployed position. In most embodiments, the ability to quickly and easily symmetrically reconfigure the deployed position of the tray table support assembly is anticipated to provide a versatility that is heretofore not seen in the prior art.

FIG. 11A shows the reconfigurability of the tray table apparatus 10. The support shelf 29 of the tray table support assembly 21 includes two pair of pivot axes PA1, PA2, each representing the positions of the pivot blocks 37 for each of the two deployment configurations. The pivot axes PA1, PA2 are equidistant from the lateral centerline CL1 of the support shelf 29. To reconfigure the tray table apparatus 10, the base plate 36 is released from the first side 95 of the support shelf 29 by releasing the threaded knobs 38 from the support shelf 29 and affixing the base plate 36, along with the coupled pivot blocks 37, support arm 39, and the tray table 13, to the second side 97 of the support shelf 29. Thus, as shown and described, the tray table support assembly 21 may be easily and quickly reconfigured from one of the deployed positions to the other, such as, for example, to be used with a bed positioned on either side of the night table 11.

Described another way, as part of the reconfiguration, the support arm 39 is alterable between a first state and a second state. In the first state, the first end 40 of the support arm 39 is pivotably coupled to the support shelf 21 so as to be pivotable about a the pivot axis PA2 between a first folded position and a first unfolded position in which the support arm 39 extends in a first inclined orientation such that the second end 66 of the support arm 39 is located laterally beyond the first edge 96 of the support shelf 29. In the second state, the first end 40 of the support arm 39 is pivotably coupled to the support shelf 21 so as to be pivotable about a the pivot axis PA1 between a second folded position and a second unfolded position in which the support arm 39 extends in a second inclined orientation such that the second end 66 of the support arm 39 is located laterally beyond the second edge 98 of the support shelf. Comparing the first state and the second state of the support arm 39, the first folded state of the support arm 39 is symmetrical about the lateral centerline CL1 of the support shelf 29 with the second folded state of the support arm 39. Similarly, the first extended position of the support arm 39 is symmetrical about the lateral centerline CL1 of the support shelf 29 with the second extended position of the support arm 39.

Figure 12:
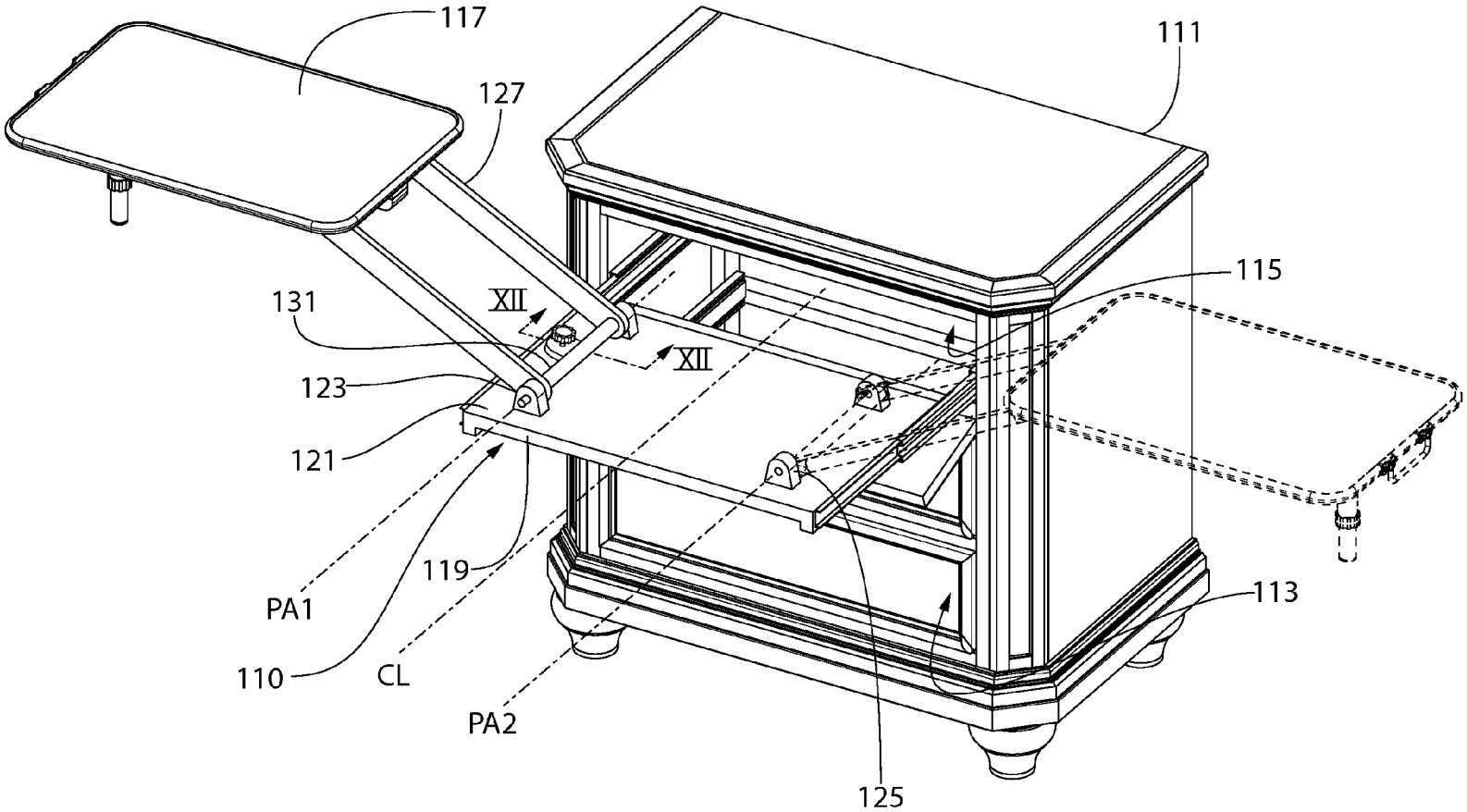
FIG. 12 is a perspective view of a second embodiment of a tray table apparatus having a stowable tray table.

A second embodiment of a tray table apparatus 110, again shown in context coupled to a night table 111, is illustrated in FIG. 12. This night table 111 also includes a lower storage compartment 113 and an upper storage compartment 115. As with other embodiments of the tray table apparatus 110 described herein, the tray table apparatus 110 may be coupled to any structural support other than a night stand or furniture. The tray table apparatus 110 includes a tray table 117 and a tray table support assembly 119. As will be appreciated, one or more of the features described above for the tray table apparatus 10 may be incorporated into the tray table apparatus 110 as desired. The tray table apparatus 110 is shown in the deployed position, and the tray table apparatus 110 may be transitioned to a stowed position to be stowed within the upper storage compartment 113. The tray table support assembly 119 includes a support shelf 121 which includes two pair of pivot blocks 123, 125, each pair defining a pivot axis PA1, PA2. The pivot axes PA1, PA2 are parallel to each other and equidistantly spaced apart on opposite sides of the lateral centerline CL1 of the support shelf 121. The support arm 127 of the tray table support assembly 119 is pivotably coupled to the tray table 117 and to one of the two pair of pivot blocks 123, 125, so that the support arm 127 pivots, with respect to the support shelf 121, along one of the two pivot axes PA1, PA2. As shown, the pivot member 131 of the support arm 127 is coupled to the first pair of pivot blocks 123, and the coupling is achieved with a removable fastener, such as a locking pin, a thumb screw, a screw element with a knob on one end, or the like, so that the support arm 127 may be easily and quickly removed from the first pair of pivot blocks 123 and pivotably coupled to the second pair of pivot blocks 125. In doing so, the tray table apparatus 110 may be easily and quickly reconfigured, such as, for example, to be used with a bed positioned on either side of the night table 111. The tray table apparatus 110 is therefore provided with easy symmetrical reconfigurability, such that the two available deployed positions of the tray table apparatus 110, one when the support arm 127 is pivotably coupled to the first pair of pivot blocks 123 and the other when the support arm 127 is pivotably coupled to the second pair of pivot blocks 125, are symmetrical about the lateral centerline CL1 of the support shelf 121.

Figure 13:
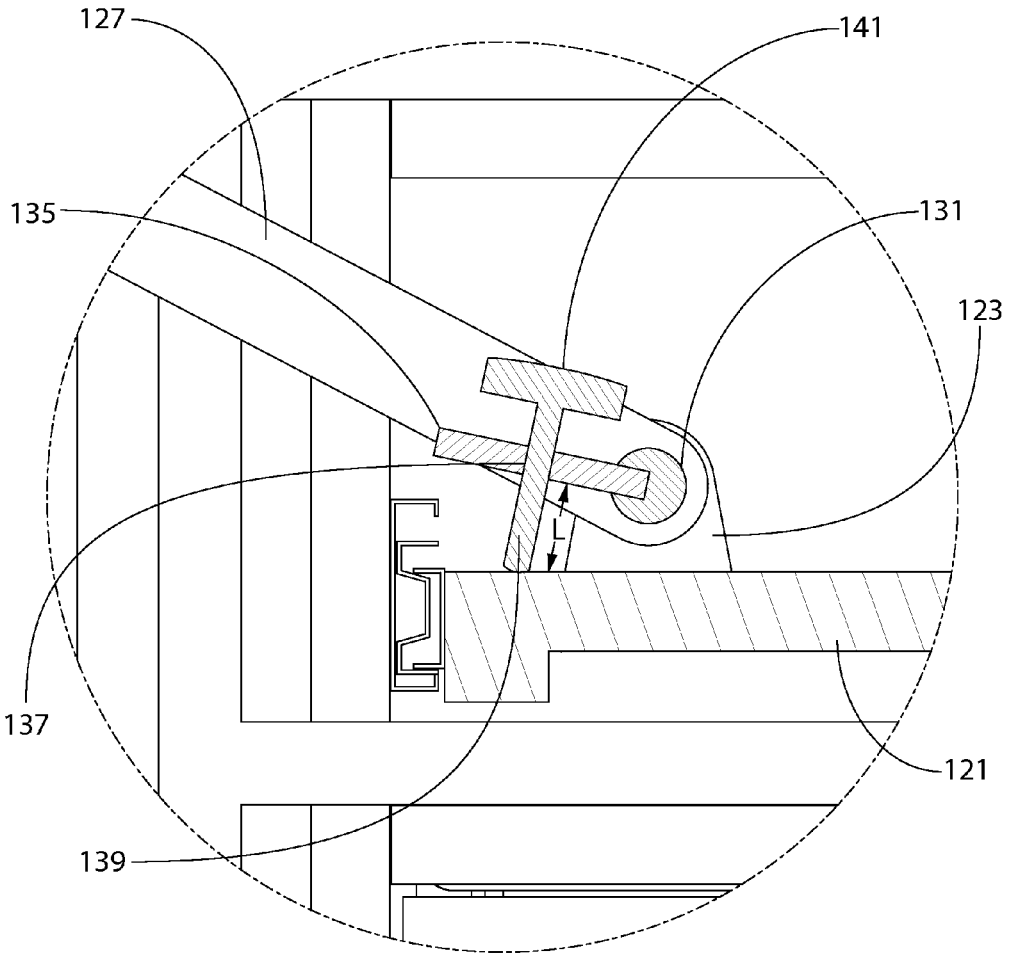
FIG. 13 is a sectional view of the tray table support assembly along the line XII-XII of FIG. 12, showing the adjustable pivot stop.

The tray table support assembly 119 also includes a pivot stop 133 which is affixed to the pivot member 131 of the support arm 127, as is shown in FIG. 13. The pivot stop 133 includes a plate 135 which is affixed to and rotates with the pivot member 131, and the plate 135 includes a threaded hole 137 therethrough. A screw element 139 is engaged with the threaded hole 137, such that a length L of the screw element extends entirely through the plate 135 to extend outward from both sides. A knob 141 is coupled to the screw element 139 on one side of the plate 135 to facilitate rotation of the screw element 139 by a user. The end of the screw element 139 extending from the plate 135 on the opposite side as the knob 141 is positioned to abut against the support shelf 121. With this configuration, the screw element 139 serves to limit the pivot motion of the support arm 127. Rotation of the knob 141 adjusts the length L of the screw element 139 extending beyond the bottom edge of the plate 135, such that the length L of the screw element 139 serves to determine the height of the tray table 117, e.g., the height of the tray table 117 above the bed, when the tray table support assembly 119 is in the deployed position.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A tray table apparatus comprising:

a tray table; and a tray table support assembly coupled to the tray table, the tray table and the tray table support assembly configured to transition between a stowed position and a deployed position, the tray table support assembly comprising:

a support shelf;

a support arm having a first end pivotably coupled to the support shelf so as to be pivotable about a first pivot axis and a second end, the tray table pivotably coupled to the second end of the support arm so as to be pivotable about a tray table pivot axis; and an adjustable pivot stop positioned to limit pivot movement of the support arm about the first pivot axis in the deployed position, such that a selected adjustment position of the adjustable pivot stop determines an angle of inclination formed between the support arm and the support shelf;

wherein the adjustable pivot stop has an infinite number of adjustment positions.

2. The tray table apparatus of claim 1, the tray table support assembly further comprising a tray pivot block pivotably coupling the second end of the support arm to the tray table, wherein the tray pivot block and tray table are translatable, relative to the support arm, in a direction parallel to the tray table pivot axis.

3. The tray table apparatus of claim 2, wherein:

the second end of the support arm includes a pivot member pivotably coupled to the tray pivot block, the pivot member having an indent at a centered position of the support arm; and the tray pivot block includes a biased ball assembly positioned to engage the indent when the tray table is in the centered position with respect to the support arm.

4. The tray table apparatus of claim 1, wherein in the stowed position, the support shelf, the support arm, and the tray table are positioned in a plurality of parallel planes.

5. The tray table apparatus of claim 1, the tray table support assembly further comprising a support leg pivotably coupled to a bottom surface of the tray table;

wherein the support leg is configured to be adjustable in length.

6. The tray table apparatus of claim 1, wherein the adjustable pivot stop comprises a screw element coupled to a knob.

7. The tray table apparatus of claim 6, wherein the screw element threadedly engages a threaded receptacle secured to the support shelf.

8. The tray table apparatus of claim 1, wherein a handle is affixed to an end of the tray table, the handle configured to be pivotable and gravity biased.

9. The tray table apparatus of claim 1, wherein the adjustable pivot stop is movable in a vertical direction.

10. A tray table apparatus comprising:

a support structure;

a tray table;

a tray table support assembly coupled to the tray table and mounted to the support structure, the tray table and the tray table support assembly configured to transition between a stowed position and a deployed position, the tray table support assembly comprising:

a support shelf having a first end and a second end opposite the first end; and a support arm having a first end and a second end, the tray table pivotably coupled to the second end of the support arm so as to be pivotable about a tray table pivot axis;

wherein the support arm is alterable between: (1) a first state in which the first end of the support arm is pivotably coupled to the support shelf so as to be pivotable about a first pivot axis between a first folded position in which the support arm lies atop the support shelf and a first unfolded position in which the support arm extends in a first inclined orientation such that the second end of the support arm is located laterally beyond the first end of the support shelf; and (2) a second state in which the first end of the support arm is pivotably coupled to the support shelf so as to be pivotable about a second pivot axis between a second folded position in which the support arm lies atop the support shelf and a second unfolded position in which the support arm extends in a second inclined orientation such that the second end of the support arm is located laterally beyond the second edge end of the support shelf.

11. The tray table apparatus of claim 10, wherein the first pivot axis and the second pivot axis are spaced from one another and parallel to one another.

12. The tray table apparatus of claim 10, wherein the support shelf has a lateral centerline, the first pivot axis located on a first side of the lateral centerline and the second pivot axis located on a second side of the lateral centerline opposite the first side of the lateral centerline.

13. The tray table apparatus of claim 10, wherein the tray table support assembly further comprises a base plate that is detachably coupled to the support shelf, the first end of the support arm pivotably coupled to the base plate; and wherein: (1) in the first state, the base plate is detachably coupled to the support shelf at a first location; and (2) in the second state, the base plate is detachably coupled to the support shelf at a second location that is different than the first location.

14. The tray table apparatus of claim 10, wherein (1) in the first state, the first pivot axis is fixed relative to the support shelf; and (2) in the second state, the second pivot axis is fixed relative to the support shelf.

15. The tray table apparatus of claim 10, wherein the support shelf is mounted to the support structure so as to be translatable, relative to the support structure, between: (1) an extended position; and (2) a retracted position.

16. The tray table apparatus of claim 10, wherein the support shelf travels in a plane of motion during alteration between the extended and retracted positions, the plane of motion being parallel to the first and second pivot axes.

17. A tray table apparatus comprising:

a tray table; and a tray table support assembly coupled to the tray table, the tray table and the tray table support assembly configured to transition between a stowed position and a deployed position, the tray table support assembly comprising:

a support shelf;

a support arm having a first end pivotably coupled to the support shelf so as to be pivotable about a first pivot axis and a second end, the tray table pivotably coupled to the second end of the support arm so as to be pivotable about a tray table pivot axis; and a tray pivot block pivotably coupling the second end of the support arm to the tray table, wherein the tray pivot block and tray table are translatable, relative to the support arm, in a direction parallel to the tray table pivot axis.

18. The tray table apparatus of claim 17, wherein:

the second end of the support arm includes a pivot member pivotably coupled to the tray pivot block, the pivot member having an indent at a centered position of the support arm; and the tray pivot block includes a biased ball assembly positioned to engage the indent when the tray table is in the centered position with respect to the support arm.

19. The tray table apparatus of claim 17, the tray table comprising a first end and a second end, the first end of the tray table pivotably coupled to the second end of the support arm, and the tray table support assembly further comprising a support leg pivotably coupled to a bottom surface at the second end of the tray table, wherein the support leg is configured to be adjustable in length.

20. The tray table apparatus of claim 19, wherein in the stowed position, the support shelf, the support arm, the tray table, and the support leg are positioned in a plurality of parallel planes.

* * * * *